United States Patent [19]

Traub

[11] Patent Number: 4,998,728

[45] Date of Patent: Mar. 12, 1991

[54] SOFT TIP FOOTBALL

[75] Inventor: Barry H. Traub, Dunwoody, Ga.

[73] Assignee: Select Service & Supply Co., Inc., Atlanta, Ga.

[21] Appl. No.: 567,030

[22] Filed: Aug. 14, 1990

[51] Int. Cl.[5] ..... A63B 41/10

[52] U.S. Cl. ..... 273/65 EB; 273/DIG. 20; 273/65 EC; 273/65 ED

[58] Field of Search ..... 273/65 R, 65 E, 65 EB, 273/65 EC, 65 ED, 65 EG, 55 R, 58 BA

[56] References Cited

U.S. PATENT DOCUMENTS

| | | | |
|---|---|---|---|
| 2,302,985 | 11/1942 | Voit et al. | 273/65 EB |
| 3,459,425 | 8/1969 | Holman | 273/65 EB |
| 4,531,737 | 7/1985 | Jacobson et al. | 273/65 R |

*Primary Examiner*—George J. Marlo

*Attorney, Agent, or Firm*—Browdy and Neimark

[57] ABSTRACT

An inflatable rubber football is provided with softened ends by leaving the ends of the bladder free of the usual reinforcement wrappings.

3 Claims, 1 Drawing Sheet

SOFT TIP FOOTBALL

FIELD OF THE INVENTION

This invention relates to footballs and more particularly to an improved football with soft ends.

BACKGROUND OF THE INVENTION

Footballs used in professional and amateur leagues are usually comprised of an inflatable rubber bladder covered with a sewn leather carcass. However, such leather footballs are relatively expensive and tend to not hold up well over time and repeated use.

Thus, for playground, so-called "pick-up" and "sandlot" and intramural type uses, Where cost is very important, footballs made of rubber have become predominant. Such rubber footballs (e.g. see Henderson U.S. Pat. No. 2,687,303) are typically made by wrapping an inflatable rubber bladder With nylon cloth and vulcanizing on a rubber cover. These types of rubber footballs hold up very well over time and use.

A problem with the prior art rubber footballs is that they tend to be very hard, especially at the tip region on each end. The primary players using rubber footballs tend to be young children and those inexperienced with the game of football. The risk of injury, potentially even serious injury such as to eyes, to players using such hard tipped football is very real.

To overcome to some extent the above-mentioned problem, namely the hardness of footballs, manufacturers have produced soft footballs made from soft foam rubber or foam plastic and the like (see for instance U.S. Pat. Nos. 4,241,918 and 4,337,944). The prior art soft footballs tend to not look or behave like regular footballs. They tend to not travel as far when kicked, thrown, or dropped, nor do they "feel" like regular footballs.

SUMMARY OF THE INVENTION

It is therefore an object of the present invention to overcome the deficiencies and problems of the prior art, such as those noted above.

It is another object of the present invention to provide o a football which looks, acts, and feels like a typical football but is actually safer than a typical football.

The above objects are met in accordance with the present invention by providing a football, preferably of the rubber type, with its tips (or ends) made softer than the previously known rubber footballs.

Thus, in accordance with the present invention, a standard type of rubber bladder is used, but the usual nylon cloth wrapping or other reinforcement is limited to only approximately the middle $\frac{2}{3}$ of the bladder, leaving approximately 1/6 of the bladder at each end unreinforced. Glue is applied to the exposed sections of the bladder so as to adhere the bladder ends to the rubber cover prior to or during vulcanization. The added softness of the ends is provided by the absence of the reinforcement on the ends of the bladder.

BRIEF DESCRIPTION OF THE DRAWING

Other objects and advantages of the present invention will become apparent from the following description of preferred embodiments taking in conjunction with the accompanying drawing in which:

The sole FIGURE (FIG. 1) is a partial cross-section of a football according to a first embodiment of the present invention.

DETAILED DESCRIPTION OF THE PREFERRED EMBODIMENTS

Figure 1:
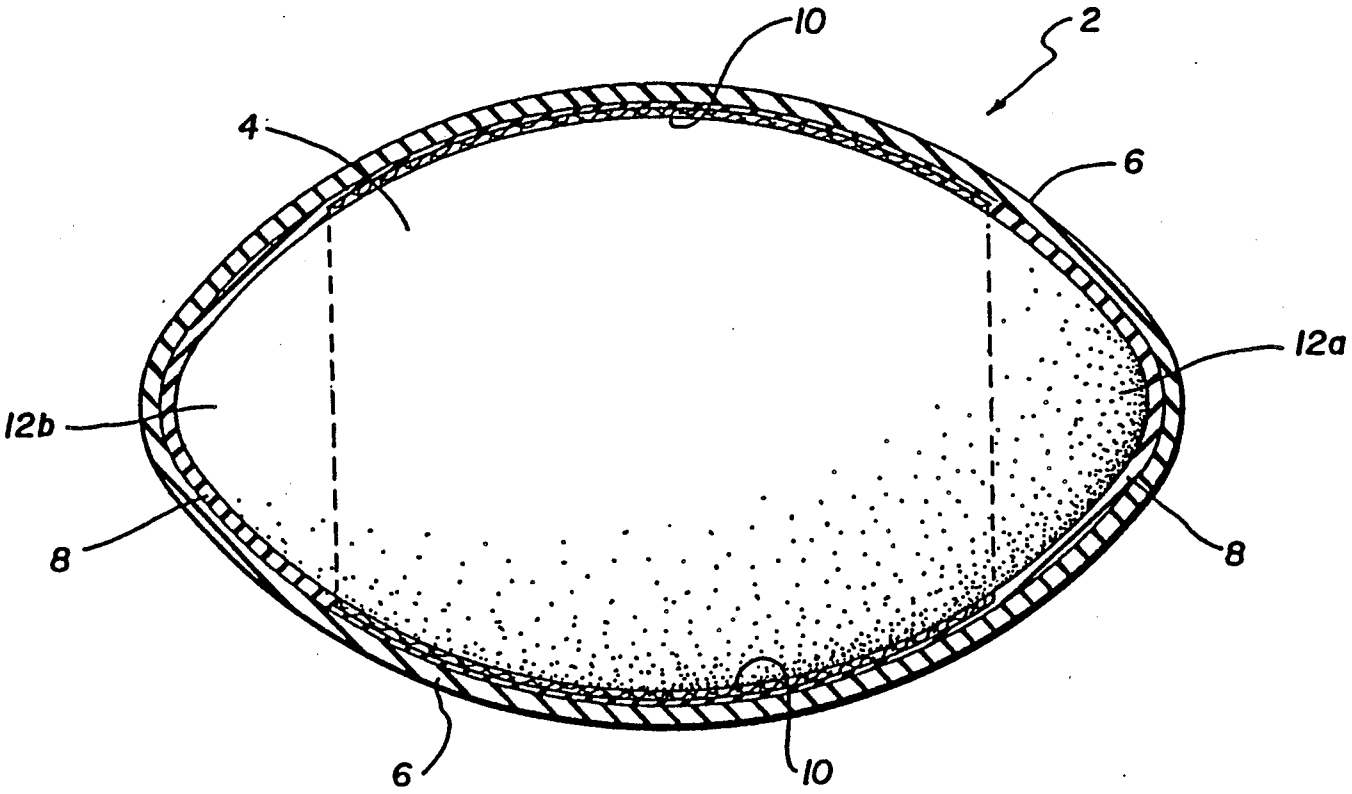

A football 2 according to the present invention is shown in FIG. 1. A conventional inflatable bladder 4, desirably of rubber, is partially covered by a typical reinforcing wrapping 10, the reinforcing wrapping 10 preferably being made of bias-weave nylon cloth. Typical prior art football bladders are covered from tip to tip by a reinforcing cloth wrapping. In the present invention, the areas of the bladder near the tips 12*a* and 12*b* are left uncovered of the reinforcing wrapping 10. Preferably a layer of glue 8 is coated onto the exposed ends of the bladder 12*a*, 12*b*.

A typical durable rubber cover 6 is then applied over the partially reinforced rubber bladder 4 in the usual way and the assembly is secured and united by vulcanization. The glue 8 on the exposed section of bladder 4 may be of the type which adheres to the sections of the rubber cover 6 prior to vulcanization, or it may be of the type which is activated by an added curing step or during the vulcanization step.

It has been found according to the present invention that if a proper amount of bladder near the tips is unreinforced, that is uncovered by any reinforcing wrapping, the finished product footballs will have much softer ends than typical prior art rubber footballs, without loss of the "feel" of a regular football. However, if too little bladder is left unreinforced, the ends will not have these softness characteristics. Contrarily, if too much bladder is left unreinforced, the bladder ends will expand out in an uncontrollable manner during inflation of the bladder and also the football will lose its "feel".

Thus, it has been found according to the present invention that optimum soft tip characteristics are provided if between approximately 58 and 80%, measured along the outside length of the ball, is covered by a reinforcement wrapping. This leaves between about 10 and 21% the bladder at each of the two ends of the ball un-reinforced, that is not covered by reinforcement wrapping. More preferably, a range of 60 to 74% of the central part of the bladder is reinforced leaving 13–20% unwrapped at each end. Even more preferably, the central $\frac{2}{3}$ of the bladder is covered by reinforcement wrapping while 1/6 of the bladder at each end is left unwrapped.

The added softness of the ends of the football in this embodiment is provided by the extra give on the unreinforced ends of the bladder. The outside appearance and the performance characteristics of the ball are nearly identical to any other regular rubber football, but because of the special construction a soft tip results which reduces the likelihood of injury to anyone playing with the ball.

A method will now be described for making a football in accordance with the present invention. As is well known in the art in making a rubber football, the first step is to partially inflate the rubber bladder 4 to a size somewhat less than the desired size of the finished football. A suitable coating of adhesive, such as a vulcanizable latex or rubber cement, may then be applied to the bladder 4, such as by dipping or spraying. Next, the reinforcing layer 10 is applied to the coated bladder 4, pieces of fabric being placed on the bladder of a fabric reinforcing layer is used, and thread or cord being wound thereon if a wound reinforcing layer is used. In accordance with the present invention, the extent of the reinforcing layer 10 is limited as noted above.

Another coating 8 of adhesive is then applied to the reinforcing layer 10 and also the exposed ends 12*a* and 12*b* of the bladder 4, and the rubber forming the cover 6, e.g. vulcanizable rubber material, is then applied. Thereafter, the so-prepared lay-up is placed in a suitable mold having a cavity corresponding in size and shape to the size and shape desired for the finished football. If a rubber cover 6 is used, the wall of the mold cavity may be provided with ridges or a pebbled texture or the like to produce any desired design, e.g. a so-called "pig skin" design on the surface of the finish football, and the wall of the mold cavity may also be formed to produce imitation stitching.

After the ball has been placed in the mold cavity, the bladder it is further inflated to press the cover 6 into intimate contact with the wall of the mold cavity and to squeeze together the bladder 4, the reinforcing material 10, and the cover 6. The mold is heated in any suitable manner to vulcanize the various rubber components of the ball together, thereby effecting lamination so that the wall structure of the football becomes integral. Subsequently, the finished ball 2 is deflated and removed from the mold.

In a first example, a ball with an inflatable rubber bladder was made with an exterior surface length of 10.5 inches, with 1.75 inches of un-reinforced tip at each end of the bladder. In this case, 1/6 of the ball at each end was left unwrapped and the central $\frac{2}{3}$ of the bladder was wrapped. In the second example, a football was similarly made having an exterior surface length of 13 inches, the unwrapped tips each having a length of 2.25 inches (17.3% of the length at each end).

Footballs according to the present invention have ends which are considerably softer and more "giving" than conventional rubber footballs, yet they retain the excellent aerodynamic qualities of conventional rubber footballs.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. For example, synthetic rubbers of various types or other elastomers such as polyurethane can be used in place of natural rubber. It is to be understood that the phraseology or terminology employed herein is for the purpose of description and not of limitation.

What is claimed is:

1. In a football having two relatively pointed ends and comprising an inflatable bladder, a reinforcement wrapping about said inflatable bladder, and a covering over said wrapped bladder, the improvement wherein the two ends of said football are rendered soft by limiting said reinforcement wrapping to a central portion of said bladder comprising 58–80% of the exterior length of said football as measured from one end to the other end, so that each of said two ends extending a length of 10–21% of said exterior of said football is not covered by reinforcement wrapping.

2. A football according to claim 1 wherein said wrapped central portion comprises 60–74% of the exterior length of the football.

3. The rubber-covered football of claim 2, wherein said wrapping covers approximately $\frac{2}{3}$ of the bladder and leaves approximately 1/6 of the bladder uncovered at each end.

* * * * *